US005469839A

United States Patent [19]

Kasulis et al.

[11] Patent Number: 5,469,839

[45] Date of Patent: Nov. 28, 1995

[54] APPARATUS FOR ENHANCING THE VISUAL EFFECTS OF A FIRE AND FOR INCREASING ITS HEAT UTILIZATION

[76] Inventors: Anthony S. Kasulis; Clara J. Kasulis, both of 9149 Mills Ave., Whittier, Calif. 90603

[21] Appl. No.: 339,796

[22] Filed: Nov. 15, 1994

[51] Int. Cl.[6] ..... F24B 1/195

[52] U.S. Cl. ..... 126/552; 126/553

[58] Field of Search ..... 126/552, 553, 126/534, 500, 535, 537, 536, 539

[56] References Cited

U.S. PATENT DOCUMENTS

| | | | |
|---|---|---|---|
| 951,020 | 3/1910 | Murphy | 126/553 |
| 4,886,047 | 12/1989 | Bonin | 126/552 |
| 5,282,459 | 2/1994 | Soule | 126/552 |

FOREIGN PATENT DOCUMENTS

| | | | |
|---|---|---|---|
| 2477681 | 9/1981 | France | 126/552 |
| 610285 | 3/1935 | Germany | 126/552 |

*Primary Examiner*—James C. Yeung

[57] ABSTRACT

An apparatus for enhancing the visual effects of a fire and for increasing its heat utilization comprising intermediate brackets having rear parts and front parts for removably supporting a mirror in an orientation offset from the vertical within a fireplace behind the fire, the rear parts including outwardly projecting fingers near an upper end and a lower end and a mirror coupled to the front part and formed of a reflective surface selected from the class of temperature resistance reflectors including glass mirrors and polished stainless steel; upper brackets having rear parts and front parts removably supporting a mirror in an orientation offset from the vertical within a fireplace behind the fire, the rear parts including outwardly projecting fingers near an upper end and a lower end and a mirror coupled to the front part and formed of a reflective surface selected from the class of temperature resistance reflectors including glass mirrors and polished stainless steel; and lower reflective components having lower horizontal sheets positionable on the floor of a fireplace, back vertical walls with rearwardly and downwardly projecting fingers near an upper extent and a lower extent of each sheet and a vertical side wall coupled to the edges of the back vertical walls and lower horizontal walls and with a diagonal upper surface thereof, the lower reflective member being formed from a reflective metal selected from the class of reflective metals including polished copper, brass and stainless steel.

4 Claims, 7 Drawing Sheets

APPARATUS FOR ENHANCING THE VISUAL EFFECTS OF A FIRE AND FOR INCREASING ITS HEAT UTILIZATION

BACKGROUND OF THE INVENTION

1. Field of the Invention

The present invention relates to a new and improved apparatus for enhancing the visual effects of a fire and for increasing its heat utilization and, more particularly, pertains to increasing the visual enjoyment of fires in a fireplace while concurrently increasing the heating effectiveness of such fires.

2. Description of the Prior Art

The use of devices for increasing the heating efficiency of fireplaces is known in the prior art. More specifically, devices for increasing the heating efficiency of fireplaces heretofore devised and utilized for the purpose of deflecting heat from the fire in a fireplace are known to consist basically of familiar, expected, and obvious structural configurations, notwithstanding the myriad of designs encompassed by the crowded prior art which has been developed for the fulfillment of countless objectives and requirements.

The prior art discloses a large number of devices for increasing the heating efficiency of fireplaces. By way of example, U.S. Pat. No. 4,194,490 to Crnkovic discloses a fireplace thermal reflector apparatus.

U.S. Pat. No. 4,320,740 to Lassy discloses a fireplace heater with reflector, heat retainer, forced draft and grate.

U.S. Pat. No. Des. 273,323 to Davidson discloses a fireplace heat exchanger.

U.S. Pat. No. 4,886,047 to Bonin discloses a fireplace heat efficiency device.

Lastly, U.S. Pat. No. 5,038,754 to Scala discloses a fireplace heat exchanger.

In this respect, the apparatus for enhancing the visual effects of a fire and for increasing its heat utilization according to the present invention substantially departs from the conventional concepts and designs of the prior art, and in doing so provides an apparatus primarily developed for the purpose of increasing the visual enjoyment of fires in a fireplace while concurrently increasing the heating effectiveness of such fires.

Therefore, it can be appreciated that there exists a continuing need for a new and improved apparatus for enhancing the visual effects of a fire and for increasing its heat utilization which can be used for increasing the visual enjoyment of fires in a fireplace while concurrently increasing the heating effectiveness of such fires. In this regard, the present invention substantially fulfills this need.

SUMMARY OF THE INVENTION

In view of the foregoing disadvantages inherent in the known types of devices for increasing the heating efficiency of fireplaces now present in the prior art, the present invention provides a new and improved apparatus for enhancing the visual effects of a fire and for increasing its heat utilization. As such, the general purpose of the present invention, which will be described subsequently in greater detail, is to provide a new and improved apparatus for enhancing the visual effects of a fire and for increasing its heat utilization and methods which have all the advantages of the prior art and none of the disadvantages.

To attain this, the present invention essentially comprises a new and improved apparatus for enhancing the visual effects of a fire and for increasing its heat utilization comprising, in combination, intermediate brackets having rear parts and front parts for removably supporting a mirror in an orientation offset from the vertical within a fireplace behind the fire, the rear parts including outwardly projecting fingers near an upper end and a lower end and a mirror coupled to the front part and formed of a reflective surface selected from the class of temperature resistance reflectors including glass mirrors and polished stainless steel; upper brackets having rear parts and front parts removably supporting a mirror in an orientation offset from the vertical within a fireplace behind the fire, the rear parts including outwardly projecting fingers near an upper end and a lower end and a mirror coupled to the front part and formed of a reflective surface selected from the class of temperature resistance reflectors including glass mirrors and polished stainless steel; lower reflective components having lower horizontal sheets positionable on the floor of a fireplace, back vertical walls with rearwardly and downwardly projecting fingers near an upper extent and a lower extent of each sheet and a vertical side wall coupled to the edges of the back vertical walls and lower horizontal walls and with a diagonal upper surface thereof, the lower reflective member being formed from a reflective metal selected from the class of reflective metals including polished copper, brass and stainless steel; vertical plates adapted to be secured to the rear wall of a fireplace adjacent the opposite lateral edges thereof, the vertical plates having vertically aligned apertures for receiving the fingers of the intermediate, lower and upper components for removable securement therebetween; and an adjustment mechanism having a dial on the exterior face of a fireplace, a lag screw coupled with respect thereto and an axially reciprocable collar adapted to move in a longitudinal direction toward and away from the exterior face of the fireplace and with a linkage member coupled thereto for operatively coupling with the upper support member whereby rotation of the dial in one direction and another will vary the angular disposition of the upper support and a mirror supported therein.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved apparatus for enhancing the visual effects of a fire and for increasing its heat utilization which has all the advantages of the prior art devices for increasing the heating efficiency of fireplaces and none of the disadvantages.

It is another object of the present invention to provide a new and improved apparatus for enhancing the visual effects of a fire and for increasing its heat utilization which may be easily and efficiently manufactured and marketed.

It is a further object of the present invention to provide a new and improved apparatus for enhancing the visual effects of a fire and for increasing its heat utilization which is of a durable and reliable construction.

An even further object of the present invention is to provide a new and improved apparatus for enhancing the visual effects of a fire and for increasing its heat utilization which is susceptible of a low cost of manufacture with regard to both materials and labor, and which accordingly is then susceptible of low prices of sale to the consuming public, thereby making such a apparatus for enhancing the visual effects of a fire and for increasing its heat utilization ,economically available to the buying public.

Still yet another object of the present invention is to provide a new and improved apparatus for enhancing the visual effects of a fire and for increasing its heat utilization which provides in the apparatuses and methods of the prior art some of the advantages thereof, while simultaneously overcoming some of the disadvantages normally associated therewith.

Even still another object of the present invention is to increase the visual enjoyment of fires in a fireplace while concurrently increasing the heating effectiveness of such fires.

Lastly, it is an object of the present invention to provide an apparatus for enhancing the visual effects of a fire and for increasing its heat utilization comprising intermediate brackets having rear parts and front parts for removably supporting a mirror in an orientation offset from the vertical within a fireplace behind the fire, the rear parts including outwardly projecting fingers near an upper end and a lower end and a mirror coupled to the front part and formed of a reflective surface selected from the class of temperature resistance reflectors including glass mirrors and polished stainless steel; upper brackets having rear parts and front parts removably supporting a mirror in an orientation offset from the vertical within a fireplace behind the fire, the rear parts including outwardly projecting fingers near an upper end and a lower end and a mirror coupled to the front part and formed of a reflective surface selected from the class of temperature resistance reflectors including glass mirrors and polished stainless steel; and lower reflective components having lower horizontal sheets positionable on the floor of a fireplace, back vertical walls with rearwardly and downwardly projecting fingers near an upper extent and a lower extent of each sheet and a vertical side wall coupled to the edges of the back vertical walls and lower horizontal walls and with a diagonal upper surface thereof, the lower reflective member being formed from a reflective metal selected from the class of reflective metals including polished copper, brass and stainless steel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
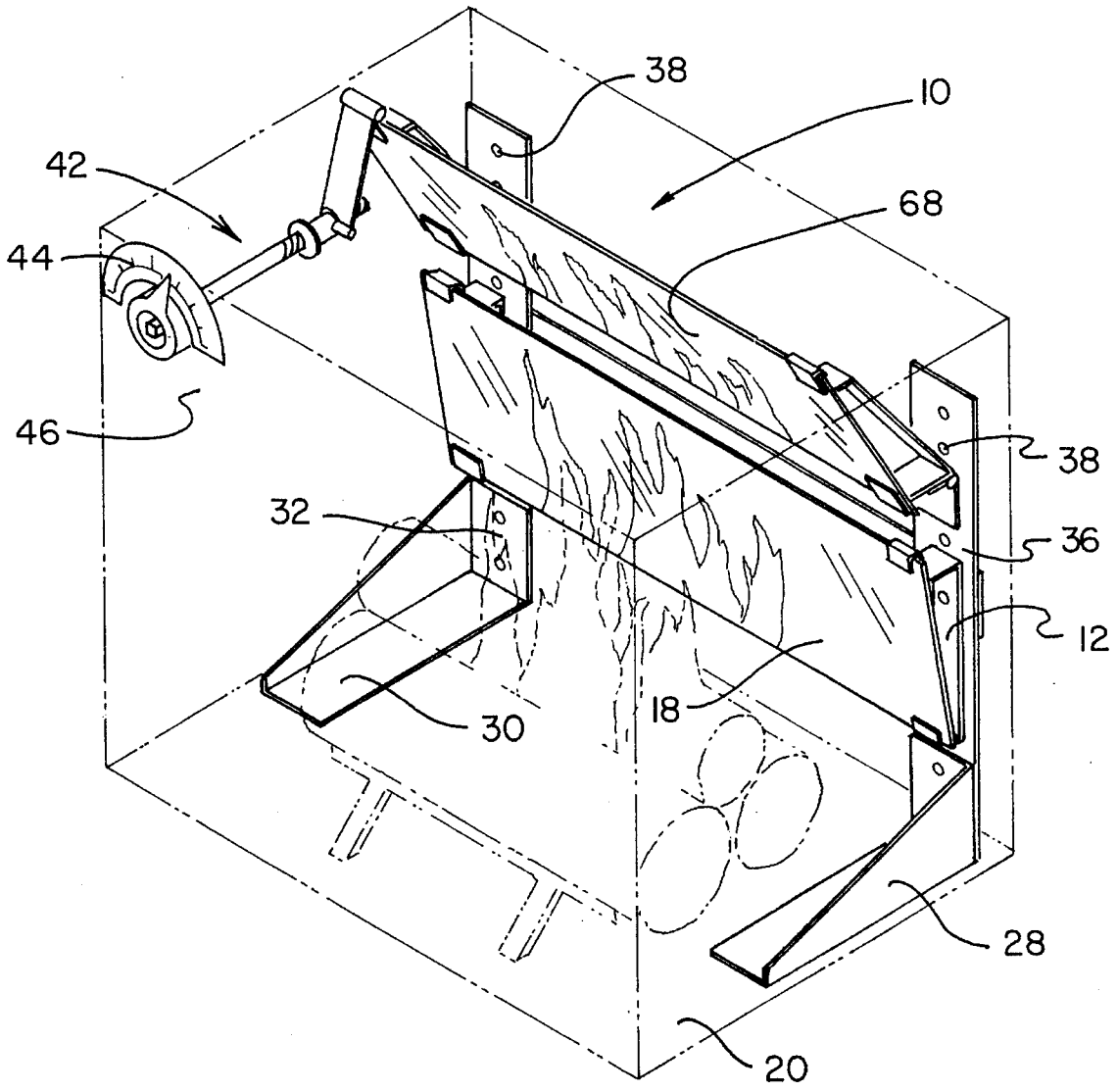
FIG. 1 is a perspective illustration of the preferred embodiment of the apparatus for enhancing the visual effects of a fire and for increasing its heat utilization constructed in accordance with the principles of the present invention.
Figure 2:
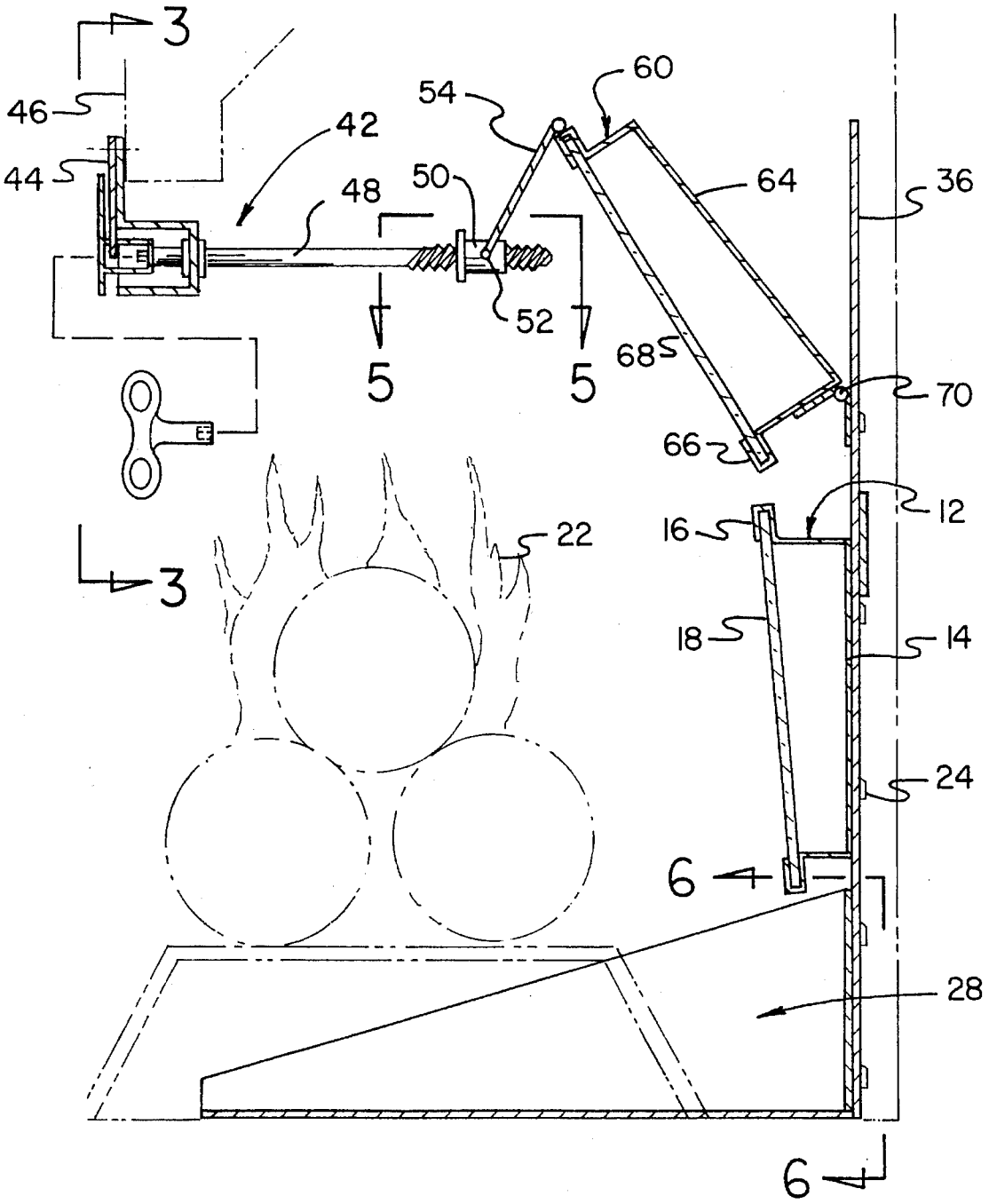
FIG. 2 is a cross-sectional view taken vertically through the center of the apparatus shown in FIG. 1.
Figure 3:
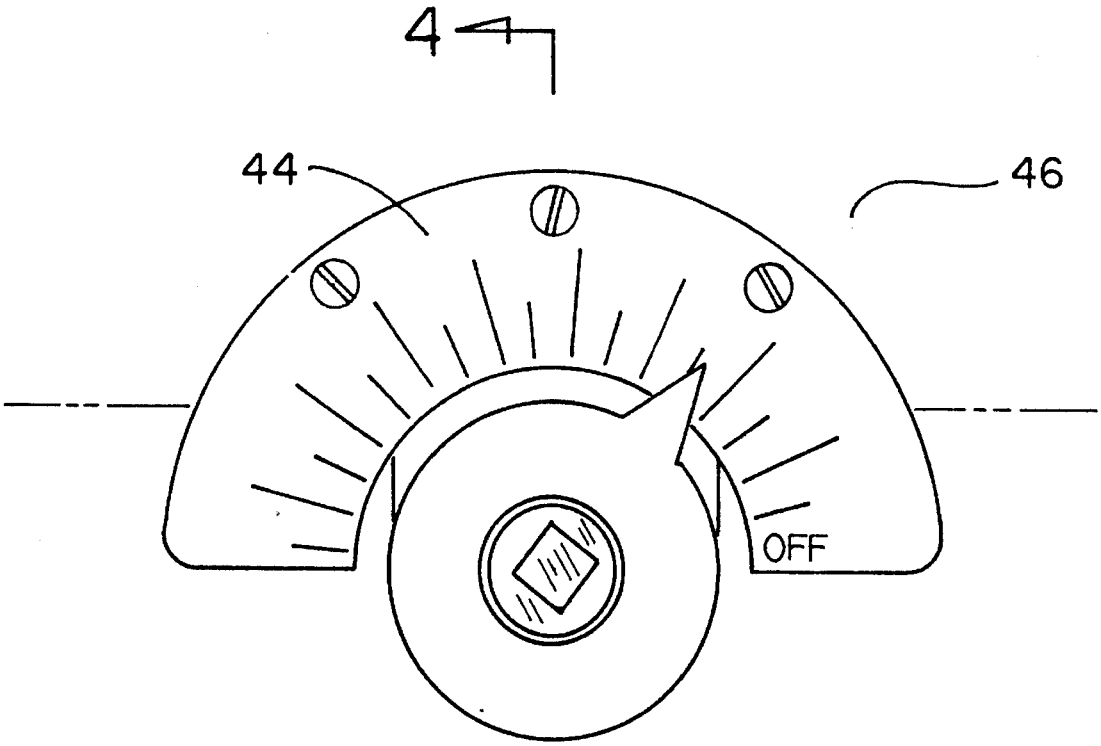
FIG. 3 is a front elevational view of the control mechanism taken along line 3—3 of FIG. 2.
Figure 4:
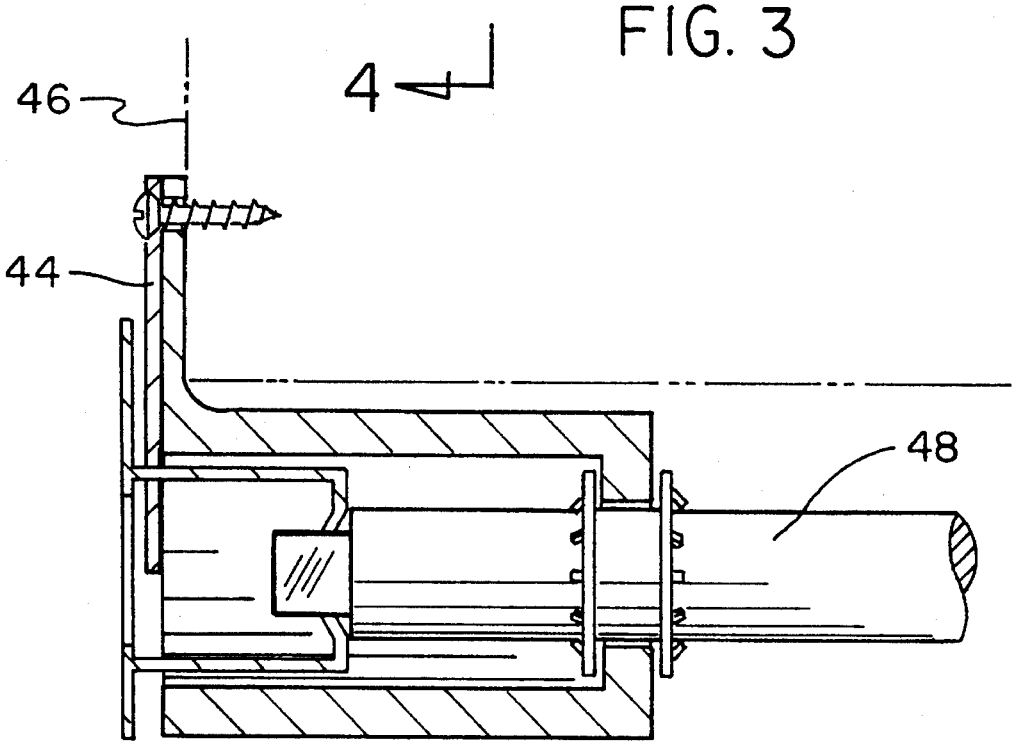
FIG. 4 is a cross-sectional view taken along line 4—4 of FIG. 3.
Figure 5:
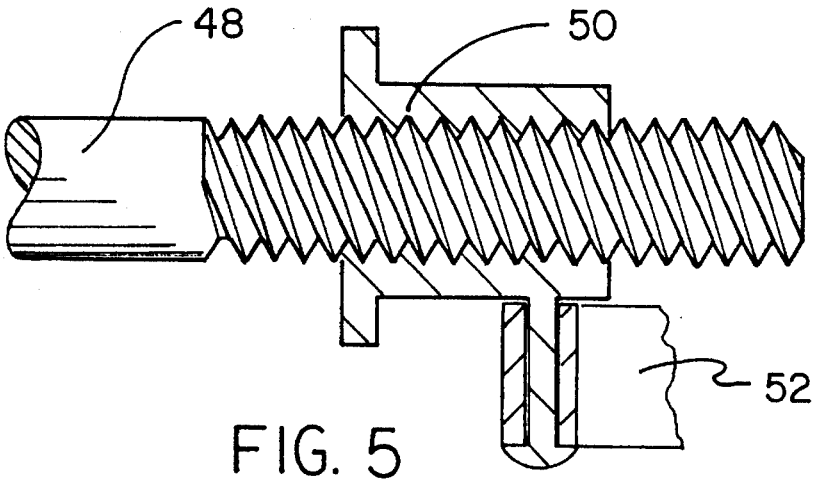
FIG. 5 is a top plan view, partly in section, taken along line 5—5 of FIG. 2.
Figure 6:
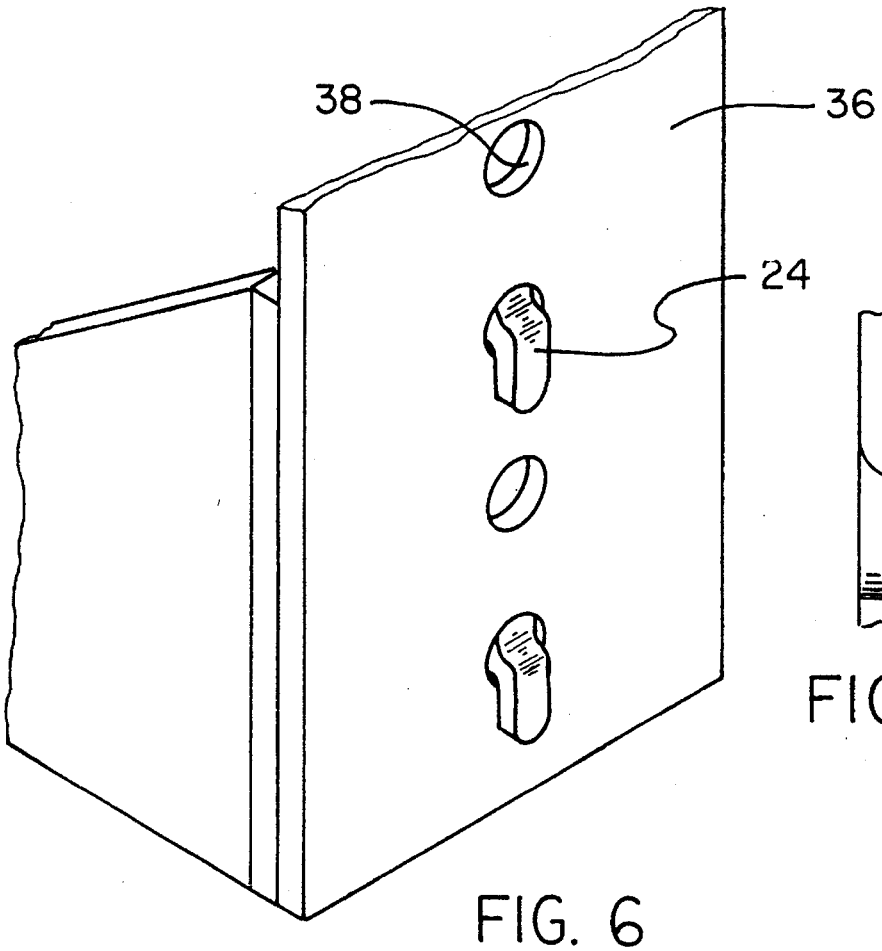
FIG. 6 is a perspective illustration of the rear components of the lower members of the apparatus shown in FIGS. 1 and 2 taken along line 6—6 of FIG. 2.
Figure 7:
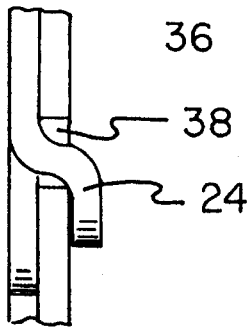
FIG. 7 is a partial side elevational view of the coupling between the lower component and the backing plate shown in FIGS. 1, 2 and 6.

With reference now to the drawings, and in particular to FIG. 1 thereof, the preferred embodiment of the new and improved apparatus for enhancing the visual effects of a fire and for increasing its heat utilization embodying the principles and concepts of the present invention and generally designated by the reference numeral 10 will be described.

The present invention, the new and improved apparatus for enhancing the visual effects of a fire and for increasing its heat utilization, is a system 10 comprised of a plurality of components. In their broadest context, the components include intermediate brackets, upper brackets, lower reflective components, vertical plates and an adjustment mechanism. Each of the individual components is specifically configured and correlated one with respect to the other so as to attain the desired objectives.

More specifically, the system 10 of the present invention includes intermediate brackets 12. Such brackets have a rear part 14 and a front part 16 removably supporting a mirror 18. Such is supported in a generally vertical orientation but tipping down forwardly at the upper extent. It is positionable within a fireplace 20 behind the fire 22. The rear parts include outwardly projecting fingers 24 near an upper end and a lower end.

In addition, a mirror is coupled to the front part. The mirror is formed of a reflective surface selected from the class of temperature resistant reflectors including glass mirrors and polished stainless steel.

The next component of the system 10 includes lower reflective components 28. Such components have lower horizontal sheets 30. Such sheets are positionable on the floor of the fireplace. Back vertical walls 32 are provided with downwardly and rearwardly projecting fingers near an upper extent and lower extent of each sheet. In addition, vertical side walls couple the edges of the back vertical walls and lower horizontal walls. A diagonal upper surface is thereby formed. The lower reflective members are formed from the reflective metal selected from the class of reflective metals including polished copper, brass and stainless steel.

Support is provided to the various components discussed above through vertical plates 36. Such plates are secured to the rear wall of the fireplace adjacent to the opposite lateral edges thereof. The vertical plates have vertically aligned apertures 38. Such apertures are for receiving the fingers of the intermediate lower and upper components. This allows for the removable securement of such components to the fireplace.

Lastly provided are adjustment mechanisms 42. Such mechanisms include a dial 44 on the exterior face 46 of the fireplace. A lag screw 48 is coupled with respect to the dial. In association with the lag screw is an axially reciprocable collar 50. Such collar is adapted to move in a longitudinal direction toward and away from the exterior face of the fireplace. A linkage member 52 is coupled thereto for operatively coupling with the upper support member. Hinges 54 are secured between the mirror and the linkage. In this manner, rotation of the dials 44 in one direction or the other will vary the angular disposition of the upper support 64 and the mirror 68 supported thereon by brackets 60, 66 through hinge 70.

Figure 8:
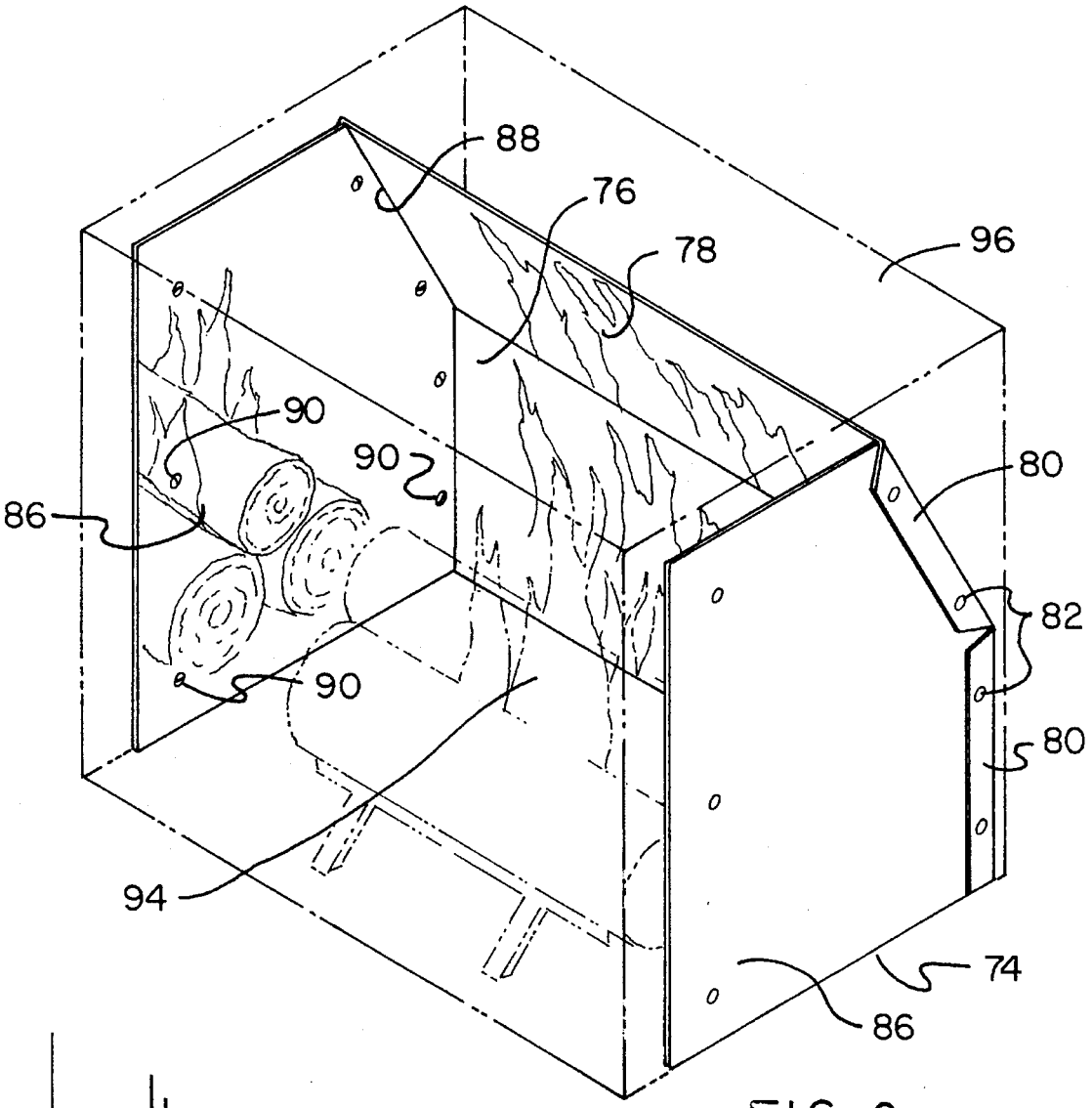
FIG. 8 is a perspective illustration of an alternate embodiment of the invention.
Figure 9:
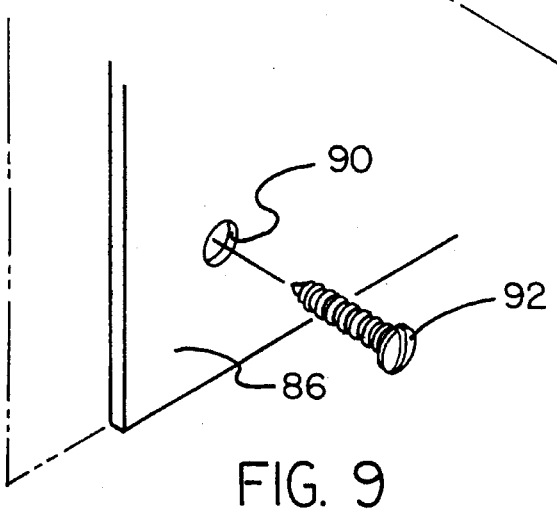
FIG. 9 is an enlarged perspective view of one corner of the device of FIG. 8.
Figure 10:
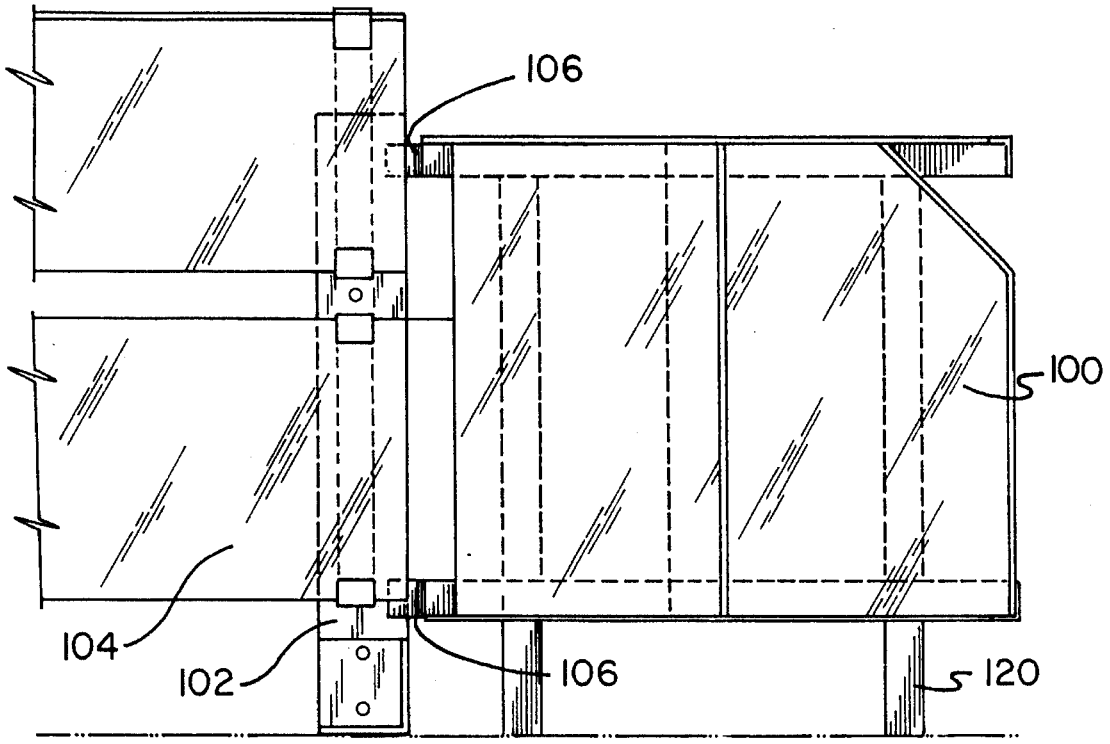
FIG. 10 is a side elevational view of a further alternate embodiment of the invention.
Figure 11:
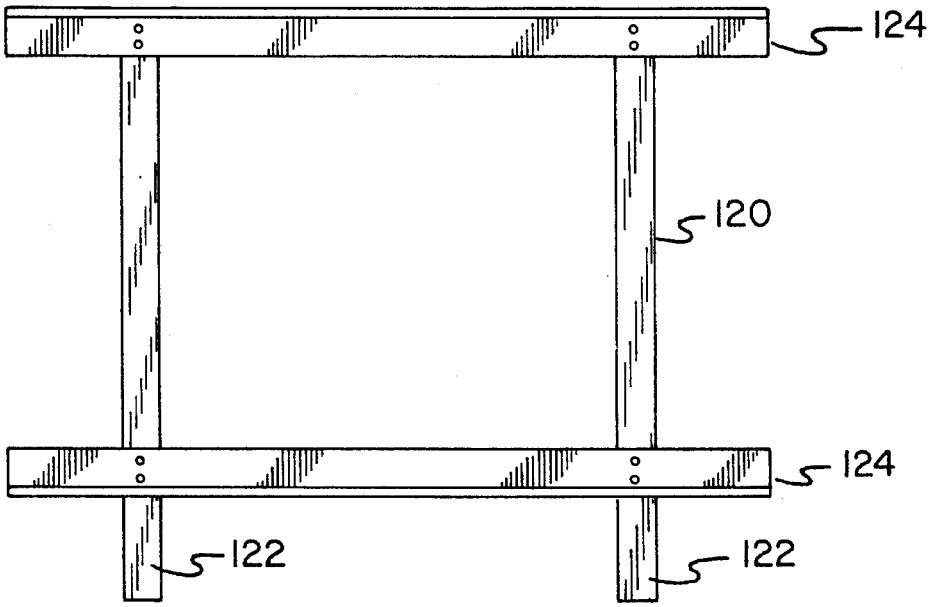
FIG. 11 is a side elevational view of the frame structure for the side panels shown in FIG. 10.
Figure 12:
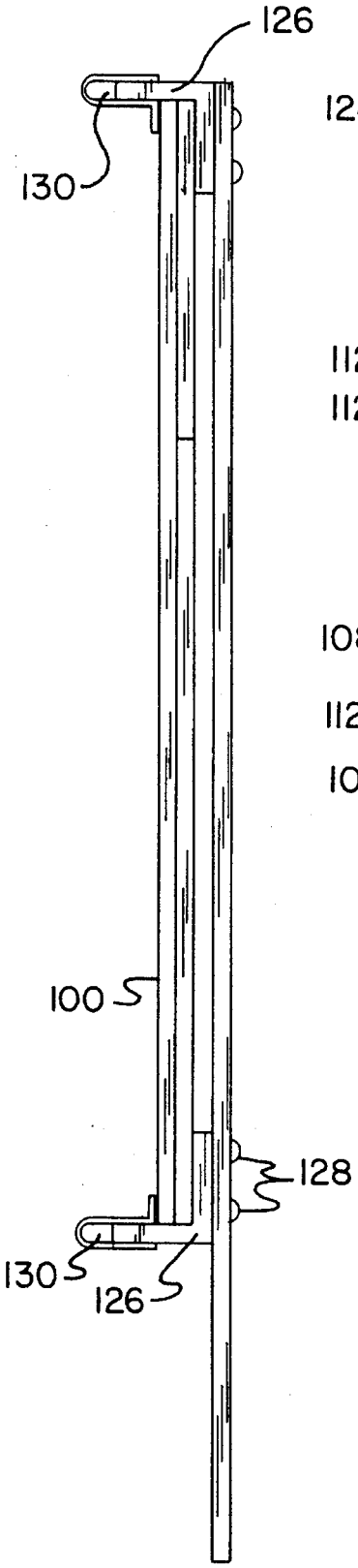
FIG. 12 is a side elevational view of the frame shown in FIG. 11.

In the embodiment shown in FIGS. 8 and 9, the reflector assembly 74 is fabricated of a plurality of separate components. Such components include a vertical reflector 76 positioned at the rear of the fireplace above that is an angled reflector 78. Such reflectors have downturned edges 80 with apertures 82 for coupling with additional component elements and the interior faces of the side walls of the fireplace.

The next adjacent components are the side reflectors 86. Two similarly shaped side reflectors are utilized. Such reflectors are rectangular in configuration except at one interior corner edge 88 wherein an angle is formed to accommodate the angled reflector 78 at the back of the fireplace. In addition, apertures 90 are formed in the side plates for coupling with the interior side spaces of the fireplace as well as the apertures 82 in the edges of the back and angled reflector plates. FIG. 9 is an enlarged perspective showing of one of the apertures 90 in plate 86 as illustrative of the way coupling may be effected through screws 92.

All of the components of this embodiment shown in FIGS. 8 and 9 are preferably of metal with a reflective interior surface furnished to maximize the effect of the reflecting fire 94 located within the fireplace 96.

Figure 13:
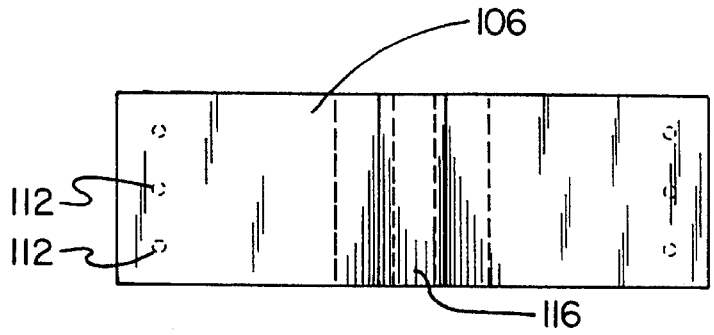
FIG. 13 is an enlarged view of one of the clips for coupling the side frame to the back frame.
Figure 14:
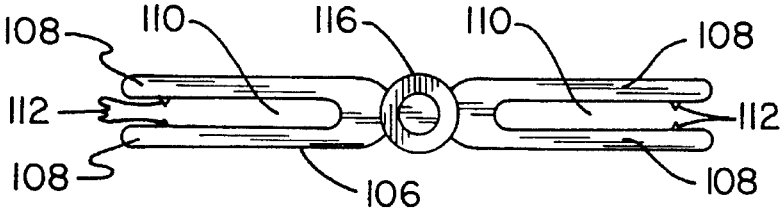
FIG. 14 is a top elevational view of the clip shown in FIG. 13.
Figure 15:
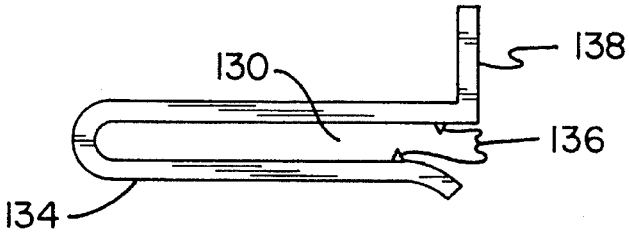
FIG. 15 is a side elevational view of a clip used in holding a mirror to the frame as shown in FIG. 12.

The embodiment of the invention shown in FIGS. 10 through 15 illustrate a coupling of a supplemental reflecting surface 100 on each side of the fireplace and extending outwardly therefrom. Such reflective side panels 100 are coupled to a frame structure 102 supporting the side reflective panels 104 within the fireplace on opposite sides of the fire. The key to such embodiment is the use of two-faced clips 106, one at the upper extent of each panel 100 with one at each lower extent thereof. FIGS. 13 and 14 show such clips 106 in greater detail.

Such clips include resilient fingers 108 on opposite sides of opposed openings 110. The clips are preferably made of a resilient metal which will function to grasp the frame structure for the mirrors that they are supporting. Teeth 112 assist in holding the supported frame component tightly with respect to the clip. Centrally located between the clip halves is a hinge 116. The hinge allows the upward reflecting panel 110 to be pivoted at any desired angle for greater convenience of the user.

Support for the pivotable reflective panel 110 is a claim assembly 120. Such a frame assembly includes vertical legs for each frame assembly and panel 110 on opposite sides of the fireplace. Horizontal components 124 are coupled at the upper extent and adjacent to the lower extent of the vertical legs 122. Horizontal L-shaped brackets 126 are secured as by rivets 128 to the vertical components 122. The L-shaped brackets have horizontal components 130 adapted to receive the reflecting panel 100 therebetween. A plurality of U-shaped clips 134 with openings 136 receive the ends of the horizontal components 130 to secure the reflective member 100 in position. Coupling is provided with greater security through fingers 136 and an extended vertical panel 138 in facing contact with the exposed surface of the reflective panel 100.

The materials of the support for the reflective panel 100, whether burnished metal or a mirror, are preferably of a resilient material such as steel which is preferably used for the panels 86 of the embodiment of FIGS. 8 and 9. This arrangement of the last embodiment allows for angling the panels to any desired degree to increase the beauty of the system. It should be understood, however, that the reflective system as used herein in all of its embodiments is an energy saving system which will insure a greater quantity of heat being reflected back into the room in which the system is utilized. As such, the invention has a wide variety of capabilities and benefits not found in the prior art with greater enjoyment to be had by a user through his senses of feel as well as sight.

The present invention greatly increases the amount of heat that is obtained from a fire in a fireplace, and also provides a dazzling visual display. Such items as heatalators aid in utilizing some of the heat that is generated in a fireplace by creating a circulating path of air around the fire and returning it into the room, and are very beneficial, but a considerable amount of heat is lost through the chimney. The walls of the combustion area are non-reflective and coated with soot so they have no other value than to direct the heat into the chimney. This invention offers another means of increasing the amount of heat that is delivered into the room. This is accomplished by reflecting the light and heat rays from the burning fire into the room.

The present invention is installed on the sides, back and top of the combustion area, to reflect the heat and light rays into the room. The difference in the amount of heat that is delivered is immediately apparent. Other than the initial expense of the installation, the additional heat is obtained without increasing any of the costs for operating the fireplace and it continues for the life of the unit.

The upper mirror is set at an angle that reflects the heat into the room without interfering with the draft that carries the smoke out through the chimney and promotes good combustion. When the mirrors become covered with soot they are cleaned very easily by brushing with a soft brush. The present invention is made of thick glass, or stainless steel which is polished to a high luster. The reflections fill the fireplace with dancing flames that are beautiful and soothing to watch.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved apparatus for enhancing the visual effects of a fire and for increasing its heat utilization comprising, in combination:

intermediate brackets having rear parts and front parts for removably supporting a mirror in an orientation offset from the vertical within a fireplace behind the fire, the rear parts including outwardly projecting fingers near an upper end and a lower end and a mirror coupled to the front part and formed of a reflective surface selected from the class of temperature resistance reflectors including glass mirrors and polished stainless steel;

upper brackets having rear parts and front parts removably supporting a mirror in an orientation offset from the vertical within a fireplace behind the fire, the rear parts including outwardly projecting fingers near an upper end and a lower end and a mirror coupled to the front part and formed of a reflective surface selected from the class of temperature resistance reflectors including glass mirrors and polished stainless steel;

lower reflective components having lower horizontal sheets positionable on a floor of a fireplace, back vertical walls with rearwardly and downwardly projecting fingers near an upper extent and a lower extent of each sheet and a vertical side wall coupled to side edges of the back vertical walls and lower horizontal walls and with a diagonal upper surface thereof, the lower reflective member being formed from a reflective metal selected from the class of reflective metals including polished copper, brass and stainless steel;

vertical plates being secured to a rear wall of a fireplace adjacent opposite lateral edges thereof, the vertical plates having vertically aligned apertures for receiving the fingers of the intermediate, lower and upper components for removable securement therebetween; and an adjustment mechanism having a dial on the exterior face of a fireplace, a lag screw coupled with respect thereto and an axially reciprocable collar adapted to move in a longitudinal direction toward and away from the exterior face of the fireplace and with a linkage member coupled thereto for operatively coupling with the upper support member whereby rotation of the dial in one direction and another will vary the angular disposition of the upper support and a mirror supported therein.

2. An apparatus for enhancing the visual effects of a fire and for increasing its heat utilization comprising:

intermediate brackets having rear parts and front parts for removably supporting a mirror in an orientation offset from the vertical within a fireplace behind the fire, the rear parts including outwardly projecting fingers near an upper end and a lower end and a mirror coupled to the front part and formed of a reflective surface selected from the class of temperature resistance reflectors including glass mirrors and polished stainless steel;

upper brackets having rear parts and front parts removably supporting a mirror in an orientation offset from the vertical within a fireplace behind the fire, the rear parts including outwardly projecting fingers near an upper end and a lower end and a mirror coupled to the front part and formed of a reflective surface selected from the class of temperature resistance reflectors including glass mirrors and polished stainless steel;

lower reflective components having lower horizontal sheets positionable on the floor of a fireplace, back vertical walls with rearwardly and downwardly projecting fingers near an upper extent and a lower extent of each sheet and a vertical side wall coupled to the edges of the back vertical walls and lower horizontal walls and with a diagonal upper surface thereof, the lower reflective member being formed from a reflective metal selected from the class of reflective metals including polished copper, brass and stainless steel; and a vertical plate being secured to a rear vertical wall of a fireplace adjacent to opposite lateral edges, the support members having vertically aligned apertures for receiving the fingers of the intermediate, lower and upper components for removable securement therebetween.

3. The device as set forth in claim 2 and further including:

an adjustment mechanism having a dial on the exterior face of a fireplace, a lag screw coupled with respect thereto and an axially reciprocable collar adapted to move in a longitudinal direction toward and away from the exterior face of the fireplace and with a linkage member coupled thereto for operatively coupling with the upper support member whereby rotation of the dial in one direction and another will vary the angular disposition of the upper support and a mirror supported therein.

4. The device as set forth in claim 2 and further including:

hinges coupling the collar and the upper mirror.

* * * * *